US011376717B2

(12) United States Patent
Chen

(10) Patent No.: US 11,376,717 B2
(45) Date of Patent: Jul. 5, 2022

(54) RATCHET WRENCH

(71) Applicant: INFAR INDUSTRIAL CO., LTD., Chang-Hua County (TW)

(72) Inventor: Chia Hsiang Chen, Chang-Hua County (TW)

(73) Assignee: Infar Industrial Co., Ltd., Chang-Hua County (TW)

( * ) Notice: Subject to any disclaimer, the term of this patent is extended or adjusted under 35 U.S.C. 154(b) by 0 days.

(21) Appl. No.: 17/153,169

(22) Filed: Jan. 20, 2021

(65) Prior Publication Data

US 2021/0291325 A1 Sep. 23, 2021

(30) Foreign Application Priority Data

Mar. 17, 2020 (TW) ..... 109108792

(51) Int. Cl.
*B25B 13/46* (2006.01)

(52) U.S. Cl.
CPC ..... *B25B 13/463* (2013.01)

(58) Field of Classification Search
CPC ..... B25B 13/463; B25B 13/13; B25B 13/06
USPC ..... 81/63, 177.85, 124.6
See application file for complete search history.

(56) References Cited

U.S. PATENT DOCUMENTS 4,328,720 A * 5/1982 Shiel ..... B25B 13/06 81/124.6
5,709,137 A 1/1998 Blacklock
5,857,390 A 1/1999 Whiteford
5,901,620 A 5/1999 Arnold
6,044,731 A 4/2000 Hsieh
6,971,286 B2 12/2005 Hu
6,990,877 B1 * 1/2006 Wu ..... B25B 13/465 81/467
7,032,478 B2 4/2006 Hu
7,104,163 B2 9/2006 Hu
7,216,568 B1 * 5/2007 Hsieh ..... B25B 13/463 81/124.3
7,270,034 B2 9/2007 Hu
8,950,295 B2 * 2/2015 Chiang ..... B25B 13/44 81/63
9,744,652 B2 * 8/2017 Liao ..... B25B 13/463
2001/0054531 A1 * 12/2001 Chang ..... B25B 13/463 192/46

(Continued)

FOREIGN PATENT DOCUMENTS

TW 488342 U 5/2002
TW 595530 U 6/2004
TW I358345 B 2/2012

(Continued)

*Primary Examiner* — Orlando E Aviles
*Assistant Examiner* — Jason Khalil Hawkins
(74) *Attorney, Agent, or Firm* — Karin L. Williams; Alan D. Kamrath; Mayer & Williams PC

(57) ABSTRACT

A ratchet wrench includes a body and a ratchet wheel. The body has a head and a handle connected to the head. The ratchet wheel is rotatably disposed in the head and has a first diameter portion, a second diameter portion connected to the first diameter portion, and a driving portion adapted to connect an object. The first diameter portion defines a first diameter in a radial direction of the ratchet wheel, and the second diameter portion defines a second diameter less than or equal to the first diameter in the radial direction of the ratchet wheel.

10 Claims, 5 Drawing Sheets

(56) References Cited

U.S. PATENT DOCUMENTS

| | | | | |
|---|---|---|---|---|
| 2004/0016321 | A1* | 1/2004 | Hsien | B25B 13/463 81/60 |
| 2007/0277652 | A1* | 12/2007 | Tuan-Mu | B25B 13/06 81/63 |

FOREIGN PATENT DOCUMENTS

| | | | |
|---|---|---|---|
| TW | M492226 | U | 12/2014 |
| TW | M509704 | U | 10/2015 |
| TW | M512473 | U | 11/2015 |
| TW | I549783 | B | 9/2016 |
| TW | I594847 | B | 8/2017 |
| TW | M589616 | U | 1/2020 |

* cited by examiner

RATCHET WRENCH

BACKGROUND OF THE INVENTION

The present invention relates to a ratchet wrench and more particularly, to a ratchet wrench having a smaller-sized driving head.

A common ratchet wrench on the market, as shown in FIG. 1 of Taiwan Utility Patent No. M492226, includes a wrench head and a ratchet wheel mounted in the wrench head. The ratchet wheel has a connecting hole for connecting with a connecting post of a pass thru socket tool. In other words, the common ratchet wrench needs to be assembled with an additional socket tool for rotating a bolt or nut. However, the additional socket tool not only increases the size of the wrench head, but also the socket tool may be detached from the connecting hole during operation, causing problems in use.

Thus, a need exists for a novel ratchet wrench that mitigates and/or obviates the above drawbacks.

BRIEF SUMMARY OF THE INVENTION

A ratchet wrench according to the present invention includes a body and a ratchet wheel. The body has a head and a handle connected to the head. The ratchet wheel is rotatably disposed in the head and has a first diameter portion, a second diameter portion connected to the first diameter portion, and a driving portion adapted to connect an object. The first diameter portion defines a first diameter in a radial direction of the ratchet wheel. The second diameter portion defines a second diameter less than or equal to the first diameter in the radial direction of the ratchet wheel.

In an example, the body is provided with a through-hole at the head in a height direction. On an inner periphery of the through-hole is formed a first annular slot. The ratchet wheel is rotatably disposed in the through-hole about a rotating axis. On an outer periphery of the second diameter portion is formed a second annular slot faced to the first annular slot. A retainer is engaged in the first and second annular slots.

In an example, the through-hole penetrates two opposite sides of the head in the height direction.

In an example, the ratchet wrench further includes a ratchet device engaged with the ratchet wheel in alternatively engaging relationship. The body is provided with a compartment interconnected with the through-hole. On the outer periphery of the second diameter portion is formed a ratchet teeth portion, which has a third diameter portion disposed between the second annular slot and the ratchet teeth portion. The third diameter portion defines a third diameter less than the second diameter in the radial direction of the ratchet wheel. The ratchet device is arranged in the compartment and includes a pawl engaged with the ratchet teeth portion.

In an example, the ratchet wrench further includes a reverse mechanism adapted to control the engaging relationship between the pawl and the ratchet wheel. The reverse mechanism includes a switch pivotally disposed in the head, and the switch is exposed on the head.

In an example, the inner periphery of the through-hole is formed with a large diameter section and a small diameter section connected to the large diameter section. The first annular slot is arranged on the large diameter section. The ratchet wheel further has a fourth diameter portion connected to the second diameter portion. The fourth diameter portion defines a fourth diameter less than the third diameter in the radial direction of the ratchet wheel. An inner diameter of the large diameter section is not less than the second diameter, and an inner diameter of the small diameter section is not less than the fourth diameter.

In an example, the driving portion is a hole penetrating two opposite sides of the ratchet wheel in the height direction. The driving portion has a first driving section adapted to connect an object and a second driving section connected to the first driving section. An inner diameter of the first driving section is greater than an inner diameter of the second driving section.

In an example, the first driving section is a polygonal hole, and the second driving section is a circular hole.

In an example, the driving portion is a hole penetrating one side of the ratchet wheel in the height direction, and the driving portion has a first driving section adapted to connect an object.

In an example, the through-hole penetrates one side of the head in the height direction, and the body further has a cover portion covering a side of the through-hole.

The present invention will become clearer in light of the following detailed description of illustrative embodiments of this invention described in connection with the drawings.

DETAILED DESCRIPTION OF THE INVENTION

Figure 1:
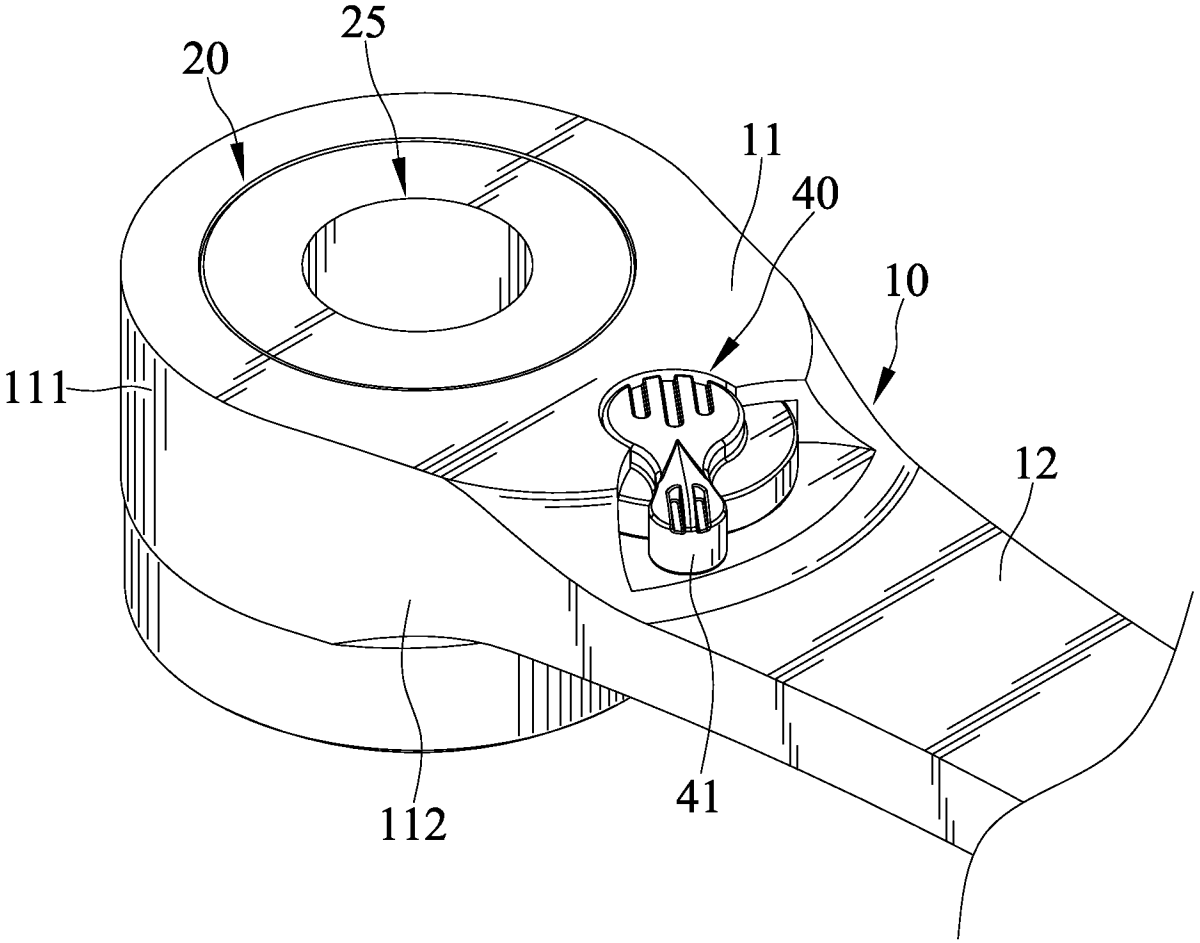
FIG. 1 is a partial, perspective view of a ratchet wrench of a first embodiment according to the present invention.
Figure 2:
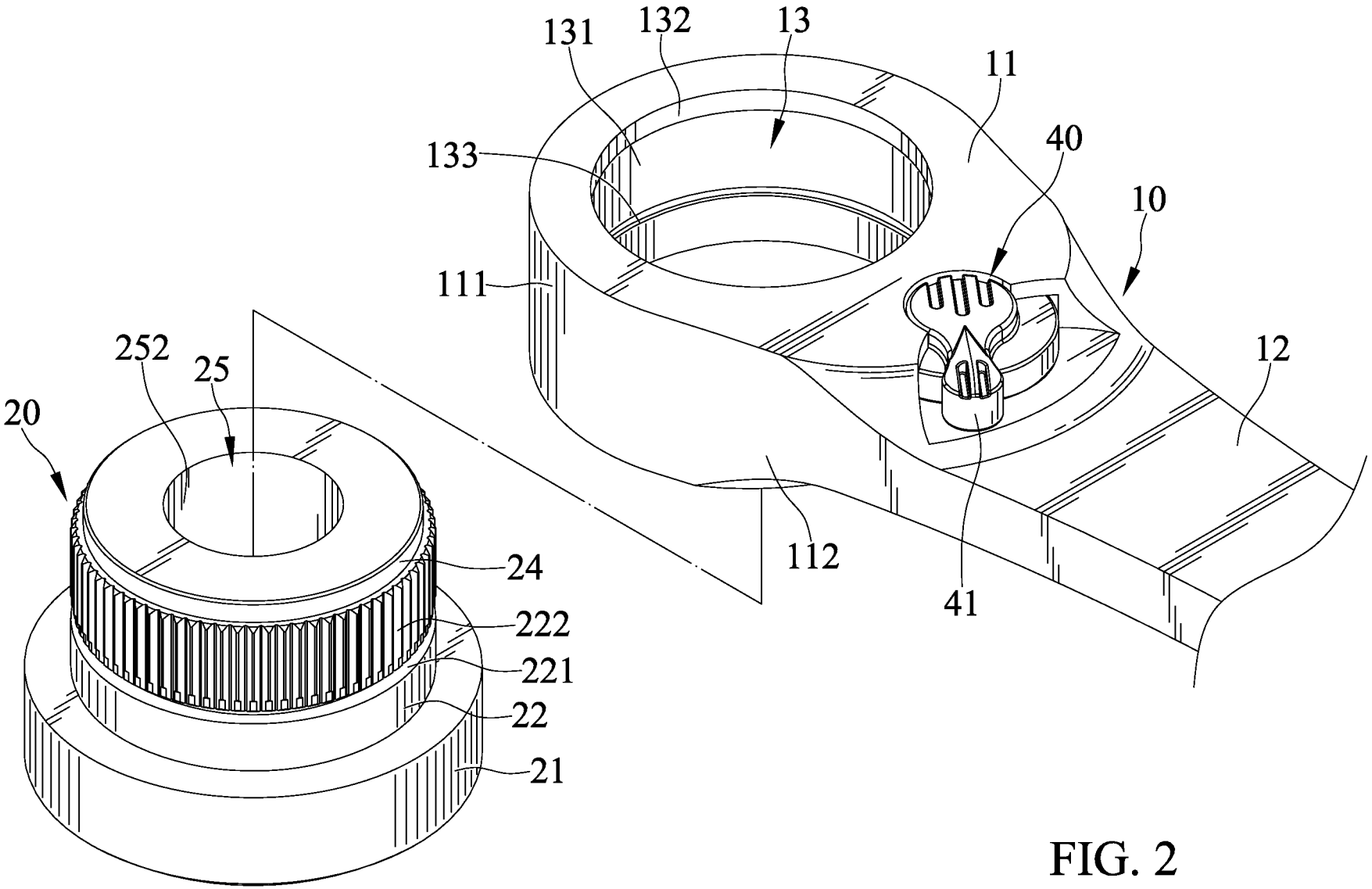
FIG. 2 is an exploded, perspective view of the ratchet wrench of FIG. 1.
Figure 3:
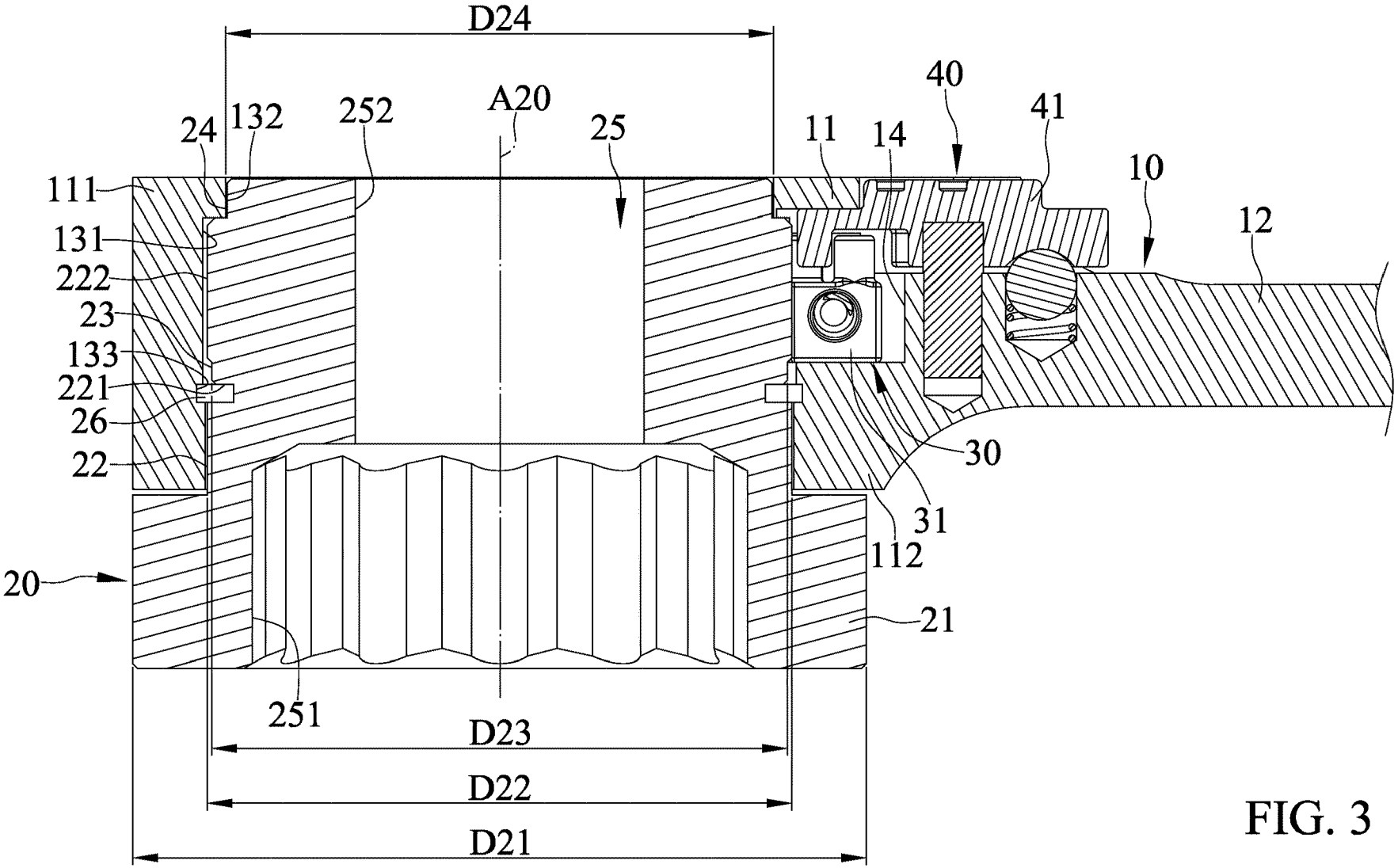
FIG. 3 is a cross sectional view of the ratchet wrench of FIG. 1.

FIGS. 1-3 show a ratchet wrench of a first embodiment according to the present invention. The ratchet wrench includes a body 10, a ratchet wheel 20 rotatably disposed in the body 10 about a rotating axis A20, a ratchet device 30 engaged with the ratchet wheel 20 in alternatively engaging relationship, and a reverse mechanism 40 adapted to control the engaging relationship between the ratchet device 30 and the ratchet wheel 20.

The body 10 has a head 11 and a handle 12 connected to the head 11. The body 10 is provided with a through-hole 13 at the head 11 in a height direction, and a compartment 14 interconnected with the through-hole 13. The head 11 has a first portion 111 and a second portion 112 opposite to the first portion 111 and connected to the handle 12. Further, the first portion 111 may be disposed at the front end of the head 11 in a length direction. In the embodiment, the through-hole 13 may penetrate two opposite sides of the head 11 in the height direction, and an inner periphery of the through-hole 13 may be formed a large diameter section 131, a small diameter section 132 connected to the large diameter section 131, and a first annular slot 133 arranged around the large diameter section 131.

The ratchet wheel 20 is rotatably disposed in the through-hole 13 of the head 11 about the rotating axis A20 and has a first diameter portion 21, a second diameter portion 22 connected to the first diameter portion 21, a third diameter portion 23, a fourth diameter portion 24 connected to the second diameter portion 22, and a driving portion 25 adapted to connect an object to be driven.

The first diameter portion 21 defines a first diameter D21 in a radial direction of the ratchet wheel 20. The second diameter portion 22 defines a second diameter D22 less than or equal to the first diameter D21 of the first diameter portion 21 in the radial direction of the ratchet wheel. In the embodiment, the second diameter D22 of the second diameter portion 22 is less than the first diameter D21 of the first diameter portion 21. An outer periphery of the first diameter portion 21 is at least aligned with an outer edge of the first portion 111 of the head 11 in the height direction. Further, the outer periphery of the first diameter portion 21 may be both aligned with the outer edges of the first portion 111 and the second portion 112 of the head 11. Thus, the special design of the ratchet wheel 20 can allow longer bolts to pass through without the need to assemble the additional socket tool to reduce the size of the head 11 and effectively maintain the structural strength of the ratchet wheel 20.

On an outer periphery of the second diameter portion 22 is formed a second annular slot 221 faced to the first annular slot 133, and a ratchet teeth portion 222 engaged with the ratchet device 30. A retainer 26 is engaged in the first and second annular slots 133 and 211 to prevent the ratchet wheel 20 detaching from the through-hole 13.

The third diameter portion 23 is disposed between the second annular slot 221 and the ratchet teeth portion 222 and defines a third diameter D23 less than the second diameter D22 of the second diameter portion 22 in the radial direction of the ratchet wheel 20. The fourth diameter portion 24 defines a fourth diameter D24 less than the third diameter D23 of the third diameter portion 23 in the radial direction of the ratchet wheel 20. Further, an inner diameter of the large diameter section 131 is not less than the second diameter D22 of the second diameter portion 22, and an inner diameter of the small diameter section 132 is not less than the fourth diameter D24 of the fourth diameter portion 24.

In the embodiment, the driving portion 25 is a hole penetrating two opposite sides of the ratchet wheel 20 in the height direction. In other words, the design of the ratchet wheel 20 of the embodiment can be used for a penetrating ratchet wrench. Understandably, the driving portion 25 may also be formed into a convex column shape to directly engage the socket. The driving portion 25 has a first driving section 251 adapted to connect the object and a second driving section 252 connected to the first driving section 251, and an inner diameter of the first driving section 251 is greater than an inner diameter of the second driving section 252. The first driving section 251 may be in the shape of a polygonal hole or a petal hole for connecting and driving the object to be driven, and the second driving section 252 may be in the shape of a circular hole or a square hole adapted to be passed by the longer object to be driven.

The ratchet device 30 is arranged in the compartment 14 and includes a pawl 31 engaged with the ratchet teeth portion 222 of the ratchet wheel 20. The reverse mechanism 40 is adapted to control the engaging relationship between the pawl 31 and the ratchet teeth portion 222 of the ratchet wheel 20. The reverse mechanism 40 includes a switch 41 pivotally disposed in the second portion 112 of the head 11. Further, the switch 41 is exposed on the second portion 112 of the head 11 for the user to switch.

Figure 4:
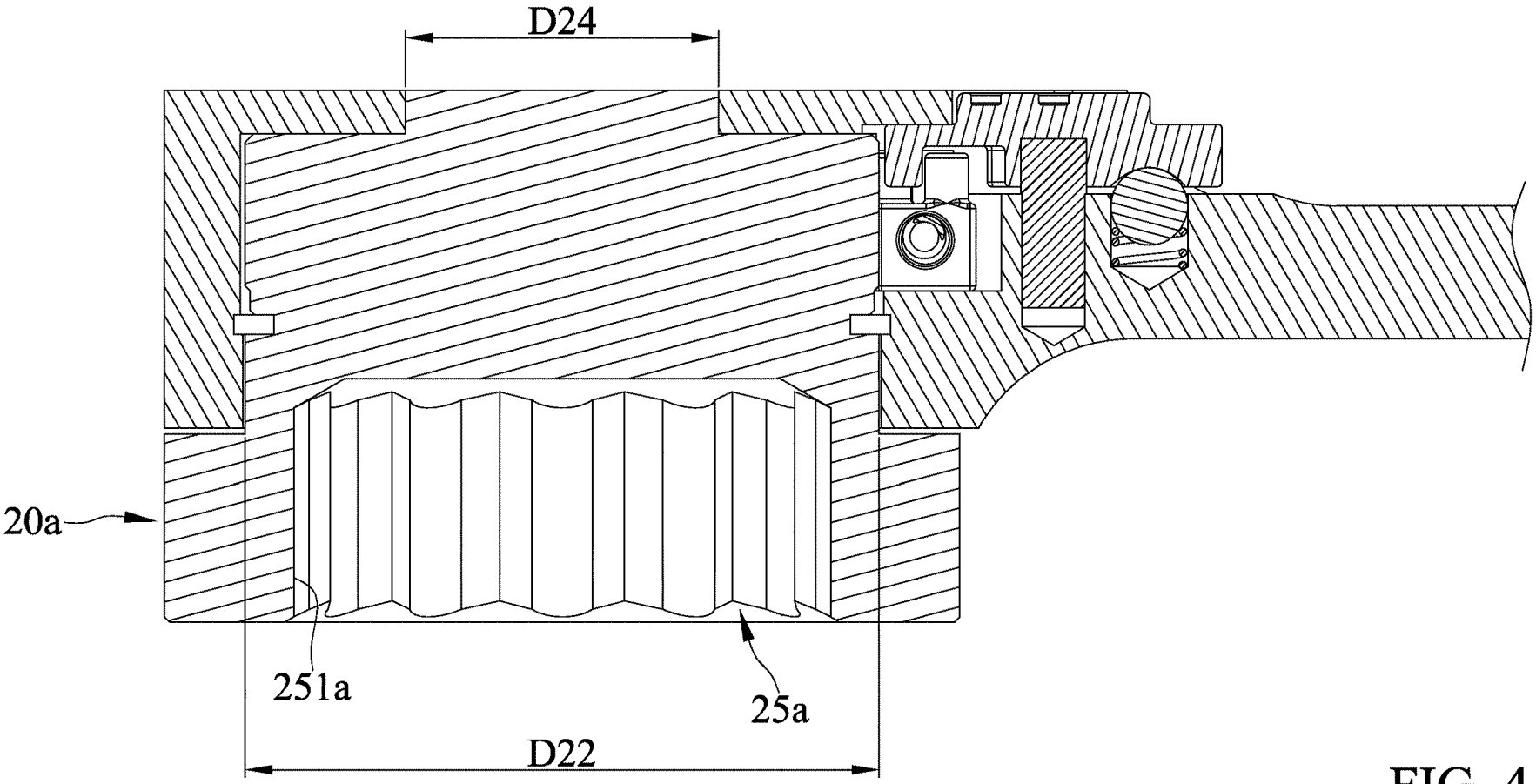
FIG. 4 is a cross sectional view of a ratchet wrench of a second embodiment according to the present invention.

FIG. 4 shows a cross sectional view of a ratchet wrench of a second embodiment according to the present invention. The second embodiment is substantially the same as the first embodiment but is mainly different from the second embodiment by that the driving portion 25*a* may be in the shape of a hole penetrating one side of the ratchet wheel 20*a* in the height direction. The driving portion 25*a* has a first driving section 251*a* adapted to connect an object. In addition, the fourth diameter D24 is only half of the second diameter D22. In other words, the design of the ratchet wheel 20*a* of this embodiment can be used for a non-penetrating ratchet wrench.

Figure 5:
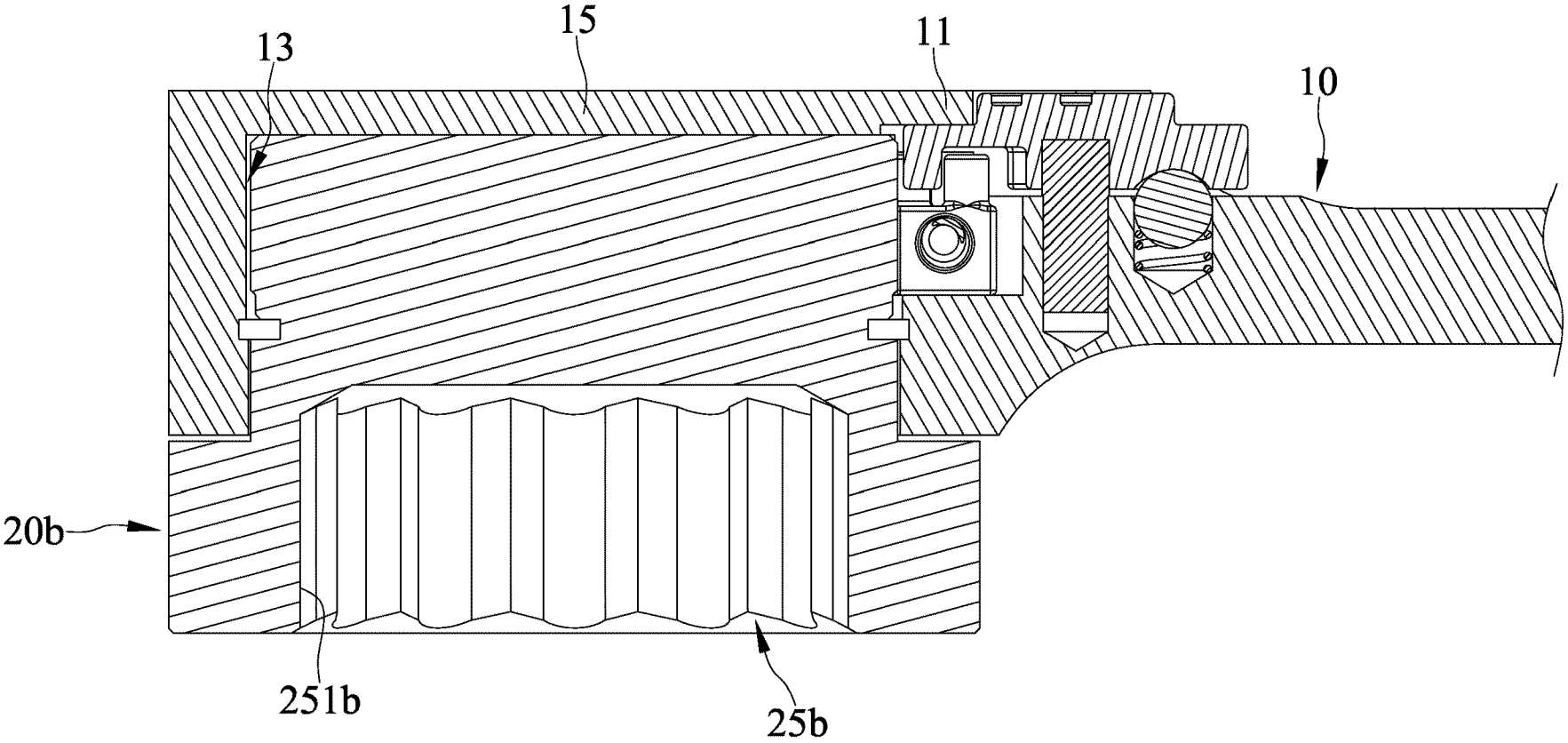
FIG. 5 is a cross sectional view of a ratchet wrench of a third embodiment according to the present invention.

FIG. 5 shows a cross sectional view of a ratchet wrench of a third embodiment according to the present invention. The third embodiment is substantially the same as the first embodiment but is mainly different from the second embodiment by that the through-hole 13 penetrates one side of the head 11 in the height direction, and the body 10 further has a cover portion 15 covering a side of the through-hole 13. Therefore, the ratchet wheel 20*b* can correspond to the cover portion 15 without the fourth diameter portion 24 (as shown in FIG. 2) in the foregoing embodiment. In addition, the driving portion 25*b* may be in the shape of a hole but does not penetrate the two opposite sides of the ratchet wheel 20*b*, and only penetrates one side of the ratchet wheel 20*b* to have a first driving section 251*b*.

Conclusively, the above-mentioned embodiment of the present invention provides a ratchet wrench with a smaller-sized drive head, whereby the second diameter D22 of the second diameter portion 22 being smaller than or equal to the first diameter D21 of the first diameter portion 21, the special design of the ratchet wheels 20, 20*a*, 20*b* reduces the size of the head 11, and effectively maintains the structural strength of the ratchet wheels 20, 20*a*, 20*b*.

Although specific embodiments have been illustrated and described, numerous modifications and variations are still possible without departing from the scope of the invention. The scope of the invention is limited by the accompanying claims.

The invention claimed is:

1. A ratchet wrench comprising:

a body having a head and a handle connected to the head, wherein the body is provided with a through-hole at the head in a height direction, wherein on an inner periphery of the through-hole is formed a first annular slot; and a ratchet wheel rotatably disposed in the head and having a first diameter portion, a second diameter portion connected to the first diameter portion, and a driving portion adapted to connect an object, wherein the first diameter portion defines a first diameter in a radial direction of the ratchet wheel, and wherein the second diameter portion defines a second diameter less than the first diameter in the radial direction of the ratchet wheel, wherein on an outer periphery of the second diameter portion is formed a second annular slot faced to the first annular slot, wherein a retainer is engaged in the first and second annular slots, wherein on the outer periphery of the second diameter portion is formed a ratchet teeth portion, wherein the ratchet wheel has a third diameter portion disposed between the second annular slot and the ratchet teeth portion, wherein the third diameter portion defines a third diameter less than the second diameter in the radial direction of the ratchet wheel, wherein the ratchet wheel further has a fourth diameter portion connected to the second diameter portion, wherein the fourth diameter portion defines a fourth diameter less than the third diameter in the radial direction of the ratchet wheel, and wherein the ratchet teeth portion is located adjacent between the third diameter portion and the fourth diameter portion.

2. The ratchet wrench as claimed in claim 1, wherein the ratchet wheel is rotatably disposed in the through-hole about a rotating axis.

3. The ratchet wrench as claimed in claim 2, wherein the through-hole penetrates two opposite sides of the head in the height direction.

4. The ratchet wrench as claimed in claim 3, further comprising: a reverse mechanism adapted to control the engaging relationship between the pawl and the ratchet wheel, wherein the reverse mechanism includes a switch pivotally disposed in the head, and wherein the switch is exposed on the head.

5. The ratchet wrench as claimed in claim 3, wherein the inner periphery of the through-hole is formed with a large diameter section and a small diameter section connected to the large diameter section, wherein the first annular slot is arranged on the large diameter section, wherein an inner diameter of the large diameter section is not less than the second diameter, and wherein an inner diameter of the small diameter section is not less than the fourth diameter.

6. The ratchet wrench as claimed in claim 2, further comprising: a ratchet device engaged with the ratchet wheel in alternatively engaging relationship, wherein the body is provided with a compartment interconnected with the through-hole, and wherein the ratchet device is arranged in the compartment and includes a pawl engaged with the ratchet teeth portion.

7. The ratchet wrench as claimed in claim 2, wherein the driving portion is a hole penetrating two opposite sides of the ratchet wheel in the height direction, wherein the driving portion has a first driving section adapted to connect an object and a second driving section connected to the first driving section, and wherein an inner diameter of the first driving section is greater than an inner diameter of the second driving section.

8. The ratchet wrench as claimed in claim 7, wherein the first driving section is a polygonal hole, and wherein the second driving section is a circular hole.

9. The ratchet wrench as claimed in claim 2, wherein the driving portion is a hole penetrating one side of the ratchet wheel in the height direction, and wherein the driving portion has a first driving section adapted to connect an object.

10. The ratchet wrench as claimed in claim 2, wherein the through-hole penetrates one side of the head in the height direction, and wherein the body further has a cover portion covering a side of the through-hole.

* * * * *